US006955243B1

(12) United States Patent
Huff

(10) Patent No.: US 6,955,243 B1
(45) Date of Patent: Oct. 18, 2005

(54) GROUND ANCHOR DEVICE FOR HOLDING A LADDER AND OTHER OBJECTS IN PLACE

(76) Inventor: Billy Huff, 1462 Hyacinth Way, Superior, CO (US) 80027

( * ) Notice: Subject to any disclaimer, the term of this patent is extended or adjusted under 35 U.S.C. 154(b) by 0 days.

(21) Appl. No.: 10/718,458

(22) Filed: Nov. 19, 2003

(51) Int. Cl.[7] ..... E06C 7/00
(52) U.S. Cl. ..... 182/107; 52/159
(58) Field of Search ..... 182/107; 52/155, 52/156, 159, 165

(56) References Cited

U.S. PATENT DOCUMENTS 1,308,393 A * 7/1919 Eggleston ..... 149/23
1,982,572 A * 11/1934 Colglazier et al. ..... 182/107
2,523,535 A * 9/1950 Little ..... 182/107
4,026,080 A * 5/1977 Meikle ..... 52/159
5,537,786 A * 7/1996 Lozier et al. ..... 52/23
5,579,794 A * 12/1996 Sporta ..... 135/88.01
5,661,933 A * 9/1997 DeJonghe ..... 52/166
2004/0134141 A1 * 7/2004 Hebbelinck ..... 52/223.1

* cited by examiner

*Primary Examiner*—Alvin Chin-Shue
(74) *Attorney, Agent, or Firm*—Edwin H. Crabtree; Ramon L. Pizarro; Donald W. Margolis

(57) ABSTRACT

A ground anchor device used for holding a ladder in place on a ground surface and next to a wall of a building. Also, the ground anchor device can be used for holding other objects in place and used as a wench or come-along. The anchor device includes a ground spike assembly adapted for receipt into the top of the ground surface. An upper end of the ground spike assembly is pivotally attached to one end of a spike mounting plate. A ratchet mounting plate is pivotally attached to an opposite end of the spike mounting plate. A ratchet assembly is mounted on an opposite end of the ratchet mounting plate. The ratchet assembly includes a ratchet wheel with ratchet strap wrapped therearound. The ratchet assembly includes a ratchet handle for tightening and loosening said ratchet strap on said ratchet wheel. One end of the ratchet strap is attached to a hook. The hook and ratchet strap are adapted for wrapping around a portion of a ladder and other objects and holding them in place.

12 Claims, 3 Drawing Sheets

GROUND ANCHOR DEVICE FOR HOLDING A LADDER AND OTHER OBJECTS IN PLACE

BACKGROUND OF THE INVENTION (a) Field of the Invention

This invention relates to an anchor device for holding objects in place and more particularly, but not by way of limitation, to a ground anchor device used for holding a ladder next to the side of a building and holding other outdoor object in place.

(b) Discussion of Prior Art

In U.S. Pat. No. 530,374 to Wilkens, a ladder attachment is described. The ladder attachment includes a foldable anchor attached to the base of a ladder. The anchor includes teeth or prongs for driving into a ground surface and holding the ladder in place. In U.S. Pat. No. 1,810,045 to Heiniger, a ladder with rubber pads and a spring member is disclosed. The spring member includes a peg for driving in the ground. The spring member is folded next to the back side of the ladder, when not in use. In U.S. Pat. No. 2,523,535 to Little, an adjustable ladder anchor is illustrated having a telescoping tube. One end of the tube includes a hook for attachment to a rung of the ladder. The other end of the chain is attached to a rod with a ground-engaging stake. In U.S. Pat. No. 4,007,807 to Pogwizd, a ladder stabilizer is disclosed having a chain attached to the base of the ladder. The other end of the chain is attached to a spike or weight box. In U.S. Pat. No. 6,089,350 to Hankins another type of ladder safety anchor is described. This anchor has anchor hooks for receipt around the lowest rung of the ladder and an elongated arm with a spike for pressing into a ground surface.

None of the above mentioned prior art patents specifically disclose the unique features, structure and fiction of the subject ground anchor device for holding a ladder and other objects in place.

SUMMARY OF THE INVENTION

In view of the foregoing, it is a primary objective of the subject invention to provide a ground anchor device that can be easily and quickly attached to various parts of a ladder for holding the ladder in place against the side of a building and preventing the ladder from slipping thereon. Also, the anchor device includes various types of spikes for receipt in different ground conditions to prevent the device from pulling loose from the ground during it's operation.

Another object of the invention is the ground anchor device is lightweight and portable. Also, the anchor device can be easily folded into a compact unit for ease in moving from one location to another and during storage.

Yet another object of the invention is the ground anchor device can be used not only for holding various items in place but it can also be used as a small portable wench or come-along for pulling different items into place.

The ground anchor device includes a ground spike assembly used for receipt into the top of a ground surface and holding the anchor device thereon. An upper end of the ground spike assembly is pivotally attached on one end of a spike mounting plate. An opposite end of the spike mounting plate is pivotally attached to one end of a ratchet mounting plate. An opposite end of the ratchet mounting plate is used for mounting a ratchet assembly thereon. The ratchet assembly includes a ratchet wheel with ratchet strap wrapped therearound. The ratchet assembly also includes a ratchet handle for tightening and loosening the ratchet strap on the ratchet wheel. An end of the ratchet strap includes a hook used for wrapping around a portion of a ladder and holding it in place, when the ladder is placed against the side of a building. Obviously, the ratchet strap and the hook can be used for holding other outdoor objects in place.

These and other objects of the present invention will become apparent to those familiar with different types of ground anchors used with ladders and other objects when reviewing the following detailed description, showing novel construction, combination, and elements as herein described, and more particularly defined by the claims, it being understood that changes in the various embodiments of invention are meant to be included as coming within the scope of the claims except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
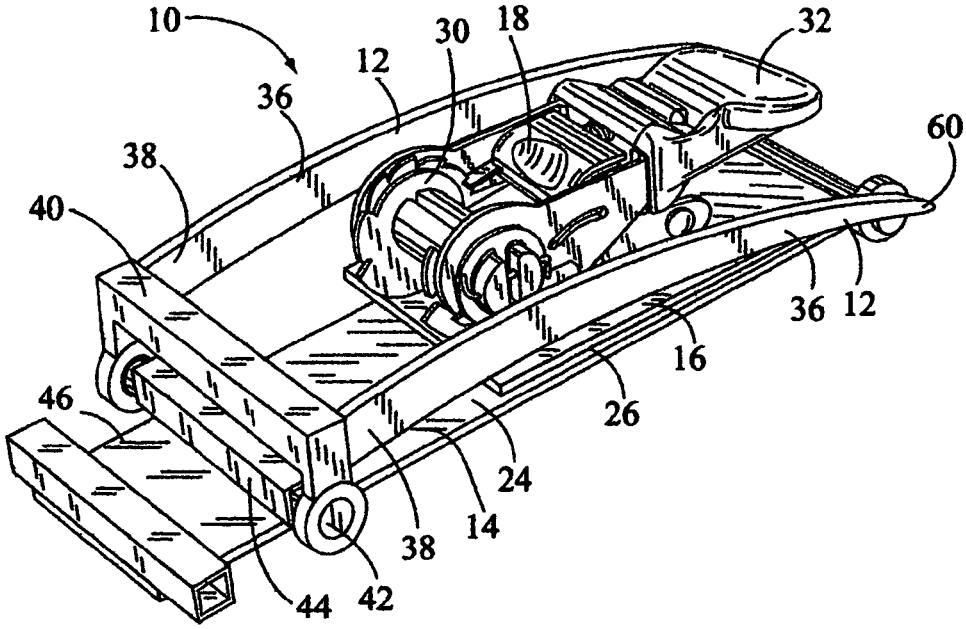
FIG. 1 is a perspective view of the ground anchor device in a folded position for storage and prior to use. In this drawing, a ground spike assembly has been folded next to the opposite sides of a ratchet assembly. Also, a spike mounting plate has been folded next to a bottom of a ratchet mounting plate.

In FIG. 1, a perspective view of the subject ground anchor device is shown having a general reference numeral 10. The ground anchor device 10 broadly includes a ground spike assembly 12, a spike mounting plate 14, a ratchet mounting plate 16, a ratchet assembly 18, a ratchet strap 20 and a hook 22 attached to one end of the strap 20. The strap 20 and the hook 22 are shown in FIG. 2.

In this drawing, the ground anchor device 10 is shown in a folded position for storage and prior to use. The ground spike assembly 12 has been folded next to opposite sides of the ratchet assembly 18. Also, a bottom 24 of the spike mounting plate 14 has been folded next to a bottom 26 of the ratchet mounting plate 16.

Figure 2:
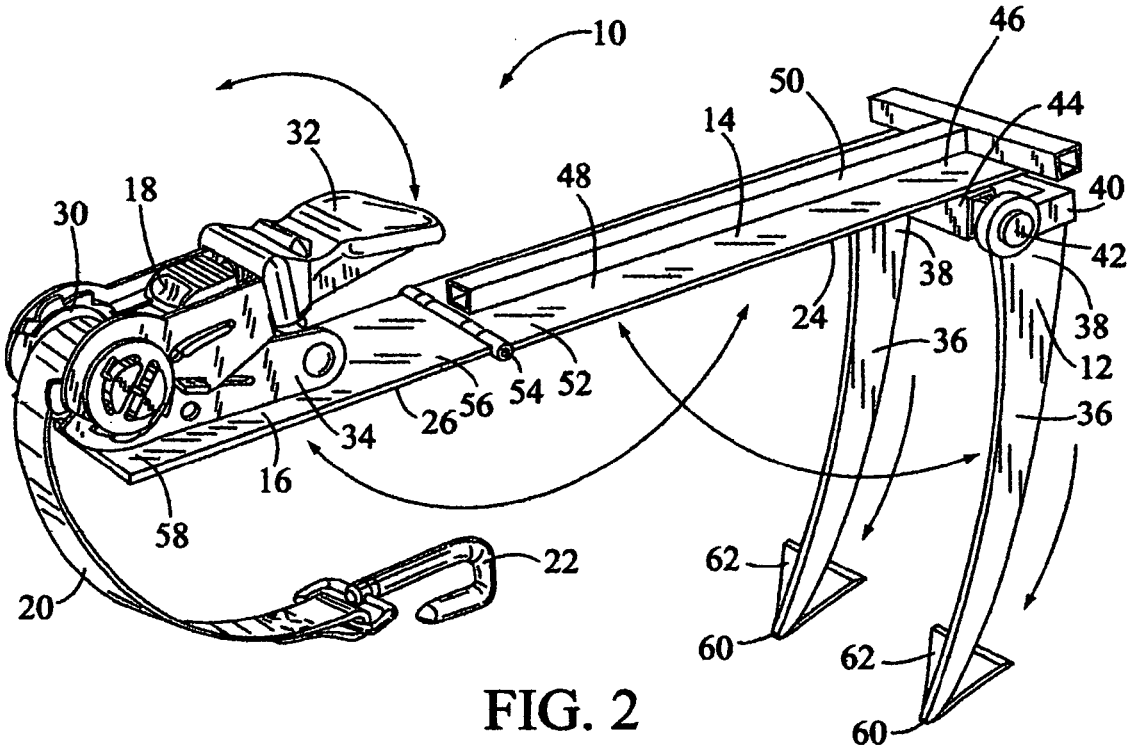
FIG. 2 is a perspective view of the ground anchor device with the ground spike assembly unfolded and ready for inserting into the top of a ground surface. Also, the spike mounting plate is unfolded from next to the ratchet mounting plate. The ratchet assembly is shown with a portion of a ratchet strap wrapped around a ratchet wheel. Further, one end of the ratchet strap is shown with a hook attached thereto.
Figure 3:
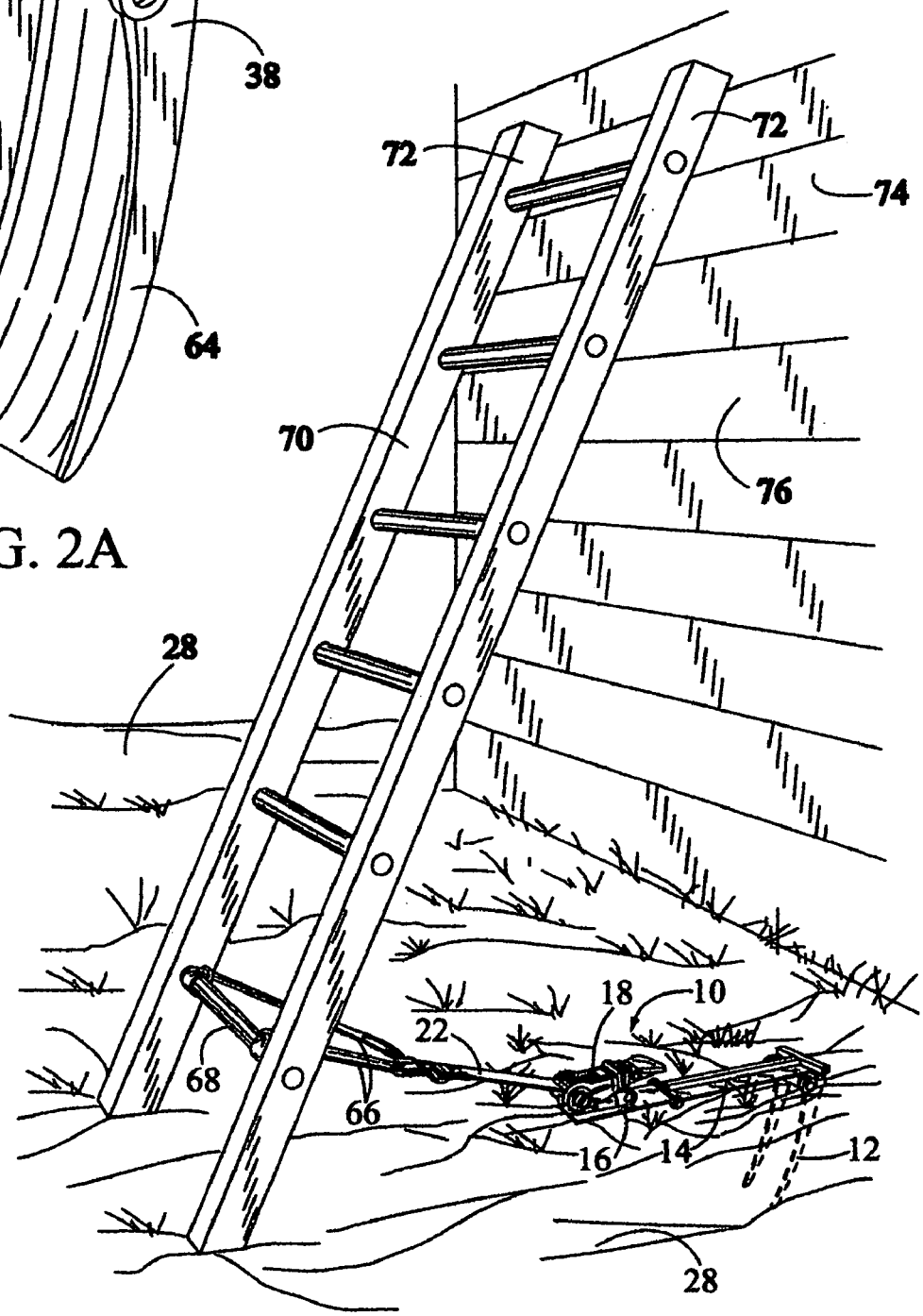
FIG. 3 is a perspective view of the ground anchor device engaging a ground surface with the ratchet strap and hook used for engaging a lower rung of a ladder and holding the ladder in place next to a wall of a building.
Figure 4:
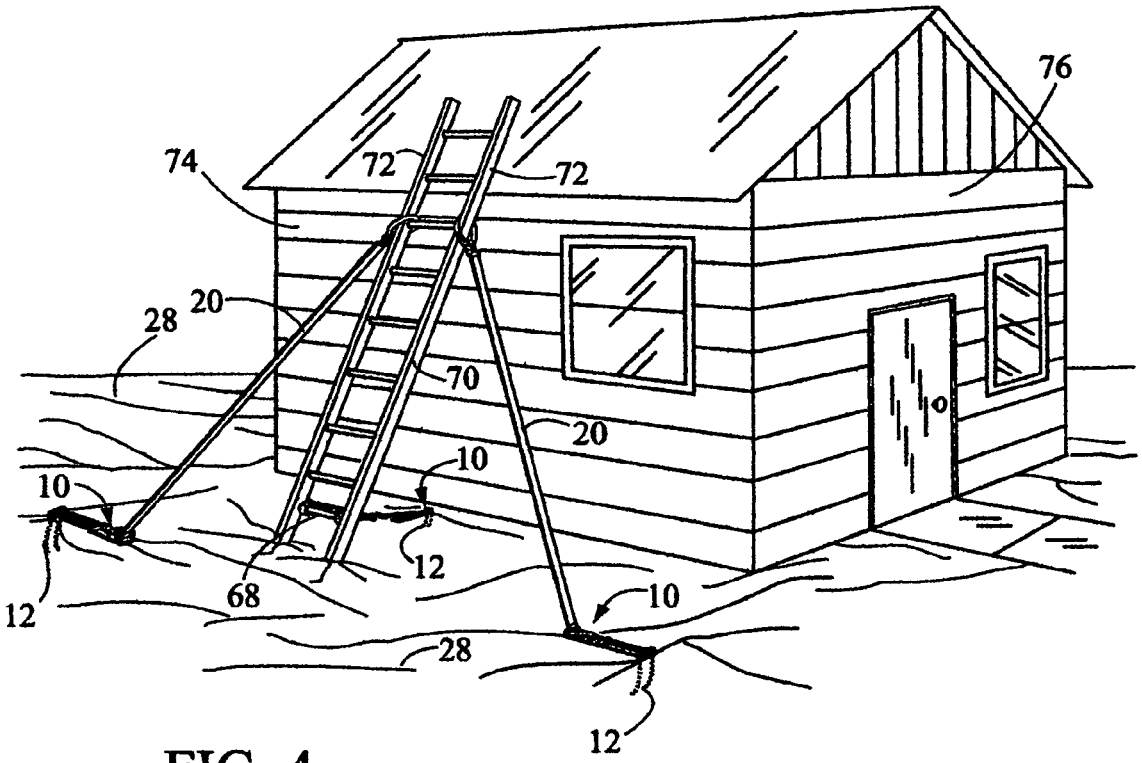
FIG. 4 is a perspective view of the use of three ground anchors attached to a ladder for preventing any movement of the ladder next to the wall of the building.
Figure 5:
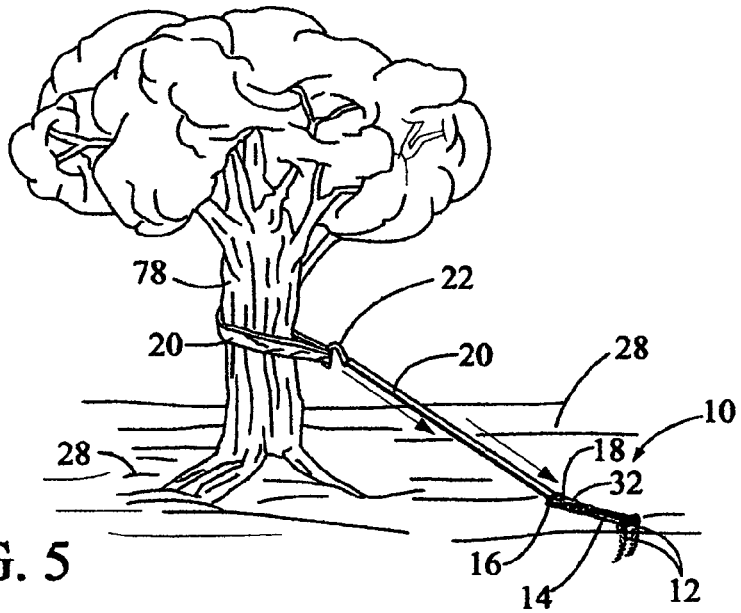
FIG. 5 is a perspective view of the ground anchor device used as a wench or come-along for helping straighten a small leaning tree into an upright vertical position.

In FIG. 2, a perspective view of the ground anchor device 10 is shown with the ground spike assembly 12 unfolded and ready for inserting into the top of a ground surface 28. The ground surface 28 is shown in FIGS. 3, 4 and 5. Also, the spike mounting plate 14 is unfolded from next to the ratchet mounting plate 16. The ratchet assembly 18 is shown with a portion of the ratchet strap 20 wrapped around a ratchet wheel 30. The ratchet assembly 18 also includes a ratchet handle 32 mounted on a ratchet housing 34. The ratchet handle 32 is used for rotating the ratchet wheel 30 and tightening or loosening the strap 20 thereon.

The ground spike assembly 12 in this embodiment includes a pair of pointed spike members 36. An upper end 38 of the spike members 36 is attached to a crossbar 40. The crossbar 40 is attached to a first pivot pin 42. The first pivot pin 42 is mounted in a pin housing 44 attached to one end 46 of the spike mounting plate 14. A top 48 of the spike mounting plate 14 includes a "T" shaped support 50 attached thereto for providing additional strength to the mounting plate 14. An opposite end 52 of the spike mounting plate 14 is hinged to a second pivot pin 54. The second pivot pin 54 is attached to one end 56 of the ratchet mounting plate 16. An opposite end 58 of the plate 16 is used for mounting the ratchet housing 34 thereon.

In this drawing, a lower end 60 of the two spike members 36 is shown with pointed blade attachments 62. The blade attachments 62 are used to help prevent the ground spike assembly 12 from pulling loose from the ground surface 28. In FIG. 1, the spike members 36 are shown without the blade attachments 62. In the embodiment in FIG. 1, the spike members 36 without the blade attachments 62, would be used in hard ground or frozen ground for ease in inserting the assembly 12 into the ground surface 28.

Figure 2A:
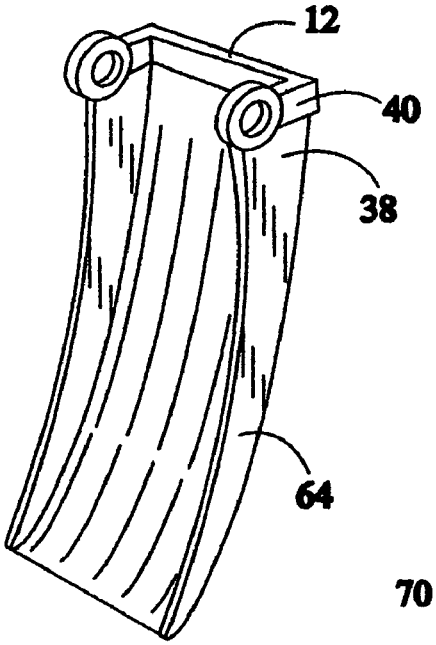
FIG. 2A illustrates a perspective view of an alternate embodiment of the ground spike assembly used in soft soil, sand and mud to prevent the anchor device from pulling loose from the ground surface during it's use.

In FIG. 2A, a perspective view of an alternate embodiment of the ground spike assembly 12 is illustrated. The assembly 12 is shown as a ground engaging scoop 64. The ground scoop 64 is used in soft soil, sand and mud to prevent the anchor device 10 from pulling loose from the ground surface during it's use.

In FIG. 3, a perspective view of the ground anchor device 10 is shown engaging the ground surface 28 with the ratchet strap 20 and the hook 22 used for engaging an accessory strap 66. The accessory strap 66 is attached to opposite ends of a lower rung 68 of a ladder 70. The accessory strap 66 is used for better load distribution when holding the ladder 70 in place. An upper end 72 of the ladder 70 is shown leaning against the side of a wall 74 of a building 76. As mentioned above, the ground anchor device 10 is designed to prevent the ladder 70 from slipping on the side of the wall 74. While the accessory strap 66 is shown in the drawings, it is obvious that the ratchet strap 20 and hook 22 can be attached directly to the ladder 70 depending on the application and use of the ground anchor device 10.

In FIG. 4, a perspective view of the use of three ground anchors 10 is shown. In this drawing, a ratchet strap 20 is attached to the lower rung 68 of the ladder 70, as shown in FIG. 3, with the addition of the straps 20 of two other ground anchors 10 attached to opposite sides of the upper end 72 of the ladder 70. In this example, the user of the ladder 70 is assured that there will be no movement of the ladder 70 during it's operation. Obviously, this type of arrangement using the ground anchors 10 would be important when the ground surface 28 is uneven or steep next to the wall 74 of the building 76.

In FIG. 5, a perspective view of the ground anchor device 10 is illustrated as a wench or come-along for helping straighten a small leaning tree 78 into an upright vertical position. In this example, the ratchet strap 20 is wrapped around a portion of a trunk 80 of the tree 78 and secured using the hook 22. The ratchet handle 32 is then used to tighten the strap 20 around the ratchet wheel 30. This example of the use of the anchor device 10 can also be applied to pulling a vehicle loose from being stuck in mud or sand and other applications where a wench or come-along is required.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A ground anchor device used for holding a ladder in place on a ground surface and next to a wall of a building and used for holding other objects in place, the anchor device comprising:

a spike mounting plate having a top, a bottom, one end and an opposite end;

a ground spike assembly including a pair of spaced apart pointed spike members, said spike members adapted for receipt into the top of the ground surface, an upper end of said spike members pivotally attached to the one end of said spike mounting plate, said spike members in a folded position disposed on opposite sides of said spike mounting plate, said spike members in an unfolded position extending downwardly at an angle from a length of said spike mounting plate;

a ratchet mounting plate having a top, a bottom, one end and an opposite end, the one end of said ratchet mounting plate pivotally attached to the opposite end of said spike mounting plate, the bottom of said ratchet mounting plate in a folded position disposed next to the bottom of said spike mounting plate, said ratchet mounting plate in an unfolded position disposed outwardly from a length of said spike mounting plate; and a ratchet assembly including a ratchet housing, said ratchet housing mounted on the opposite end of said ratchet mounting plate, said ratchet assembly including a ratchet wheel mounted on said ratchet housing, said ratchet wheel having a ratchet strap wrapped therearound, said ratchet assembly also including a ratchet handle mounted on said ratchet housing, said ratchet assembly for tightening and loosening said ratchet strap on said ratchet wheel.

2. The anchor device as described in claim 1 further including a hook, said hook attached to an end of said ratchet strap, said hook and said ratchet strap adapted for wrapping around a portion of an object and holding it in place.

3. The anchor device as described in claim 2 further including an accessory strap attached to said hook and adapted for receipt around a portion of the ladder.

4. The anchor device as described in claim 1 wherein said pair of spaced apart pointed spike members include pointed blade attachments thereon and adapted for receipt in soft ground.

5. A ground anchor device used for holding a ladder in place on a ground surface and next to a wall of a building and used for holding other objects in place, the anchor device comprising:

a spike mounting plate having a top, a bottom, one end and an opposite end;

a ground spike assembly including a pair of spaced apart pointed spike members, said spike members adapted for receipt into the top of the ground surface, an upper end of said spike members pivotally attached to the one end of said spike mounting plate, said spike members in a folded position disposed on opposite sides of said spike mounting plate, said spike members in an unfolded position extending downwardly at an angle of approximately 90 degrees from a length of said spike mounting plate, a portion of the one end of said spike mounting plate acting as a stop for holding said spike members in an unfolded position;

a ratchet mounting plate having a top, a bottom, one end and an opposite end, the one end of said ratchet mounting plate pivotally attached to the opposite end of said spike mounting plate, the bottom of said ratchet mounting plate in a folded position disposed next to the bottom of said spike mounting plate, said ratchet mounting plate in an unfolded position disposed outwardly and approximately parallel to a length of said spike mounting plate; and a ratchet assembly including a ratchet housing, said ratchet housing mounted on the opposite end of said ratchet mounting plate, said ratchet assembly including a ratchet wheel mounted on said ratchet housing, said ratchet wheel having a ratchet strap wrapped therearound, said ratchet assembly also including a ratchet handle mounted on said ratchet housing, said ratchet assembly for tightening and loosening said ratchet strap on said ratchet wheel.

6. The anchor device as described in claim 5 further including a hook, said hook attached to an end of said ratchet strap, said hook and said ratchet strap adapted for wrapping around a portion of an object and holding it in place.

7. The anchor device as described in claim 6 further including an accessory strap attached to said hook and adapted for receipt around a portion of the ladder.

8. The anchor device as described in claim 5 wherein said pair of spaced apart pointed spike members include pointed blade attachments thereon and adapted for receipt in soft ground.

9. A ground anchor device used for holding a ladder in place on a ground surface and next to a wall of a building and used for holding other objects in place, the anchor device comprising:

a spike mounting plate having a top, a bottom, one end and an opposite end;

a ground spike assembly including a pair of spaced apart pointed spike members, said spike members adapted for receipt into the top of the ground surface, an upper end of said spike members pivotally attached to a crossbar, said crossbar attached to a first pivot pin, said first pivot pin mounted in a pin housing, said pin housing attached to the one end of said spike mounting plate, said spike members in a folded position disposed on opposite sides of said spike mounting plate, said spike members in an unfolded position extending downwardly at an angle from a length of said spike mounting plate;

a ratchet mounting plate having a top, a bottom, one end and an opposite end, the one end of said ratchet mounting plate attached to a second pivot pin, said second pivot pin hinged to the opposite end of said spike mounting plate, the bottom of said ratchet mounting plate in a folded position disposed next to the bottom of said spike mounting plate, said ratchet mounting plate in an unfolded position disposed outwardly from a length of said spike mounting plate; and a ratchet assembly including a ratchet housing, said ratchet housing mounted on the opposite end of said ratchet mounting plate, said ratchet assembly including a ratchet wheel mounted on said ratchet housing, said ratchet wheel having a ratchet strap wrapped therearound, said ratchet assembly also including a ratchet handle mounted on said ratchet housing, said ratchet assembly for tightening and loosening said ratchet strap on said ratchet wheel.

10. The anchor device as described in claim 9 further including a hook, said hook attached to an end of said ratchet strap, said hook and said ratchet strap adapted for wrapping around a portion of an object and holding it in place.

11. The anchor device as described in claim 10 further including an accessory strap attached to said hook and adapted for receipt around a portion of the ladder.

12. The anchor device as described in claim 9 wherein said pair of spaced apart pointed spike members include pointed blade attachments thereon and adapted for receipt in soft ground.

* * * * *